US007331687B1

(12) United States Patent
Noh

(10) Patent No.: US 7,331,687 B1
(45) Date of Patent: Feb. 19, 2008

(54) FLUORESCENT LAMP

(75) Inventor: Si Youl Noh, Kyunggi-do (KR)

(73) Assignee: AVERD Co., Ltd., Goyang, Gyeonggi (KR)

( * ) Notice: Subject to any disclaimer, the term of this patent is extended or adjusted under 35 U.S.C. 154(b) by 0 days.

(21) Appl. No.: 11/686,584

(22) Filed: Mar. 15, 2007

(30) Foreign Application Priority Data

Oct. 12, 2006 (KR) ..... 10-2006-0099128

(51) Int. Cl.
*F21S 4/00* (2006.01)

(52) U.S. Cl. ..... 362/219; 362/217; 362/220; 362/225; 362/659

(58) Field of Classification Search ..... None
See application file for complete search history.

(56) References Cited

U.S. PATENT DOCUMENTS 6,984,055 B2 * 1/2006 McCarthy et al. ..... 362/219
2006/0133077 A1 * 6/2006 Roe ..... 362/219

* cited by examiner

*Primary Examiner*—Sharon E. Payne
*Assistant Examiner*—Kristen A Manskar
(74) *Attorney, Agent, or Firm*—JHK Law; Joseph Hyosuk Kim

(57) ABSTRACT

The present invention relates to a fluorescent lamp including: a body (110) having fixtures (120 and 120*a*) mounted at both end portions thereof so as to detachably mount a fluorescent light bulb (105) thereon; and a connecting means (130) mounted at both end portions of the body (110) so as to continuously interconnect a plurality of bodies to one another, thereby electrically connecting the bodies (110) to one another, wherein the connecting means (130) having a sliding terminal part (131) slidably coupled to the fixture (120) mounted at one side of the body (110) in such a manner as to be selectively protruded by a given length outwardly from the fixture (120) at the end portion thereof during forward and backward movements thereof, and a fixed terminal part (135) formed at the fixture (120*a*) mounted at the other side of the body (110) in such a manner as to be connected to the sliding terminal part (131) by inserting the sliding terminal part (131) thereto.

8 Claims, 6 Drawing Sheets

FLUORESCENT LAMP

BACKGROUND OF THE INVENTION

1. Field of the Invention

The present invention relates to a fluorescent lamp, and more particularly, to a fluorescent lamp that is capable of being connected with an adjacent one of a plurality of fluorescent lamps by means of a sliding terminal, thereby making the configuration simple, satisfying safety requirements thereof, making it very convenient to replace it with new one, and suppressing intermittent illumination thereof by connecting the plurality of fluorescent lamps in a close relation with one another.

2. Background of the Related Art

Generally, fluorescent lamps are disposed at a predetermined indoor or outdoor position and emit light therearound through the supply of power, and recently, they are disposed at various positions of businesses for a decoration use like a display cabinet, a show room, and so on, such that good visual effects are obtained therefrom. Thus, in order to achieve high decorating effects with just the fluorescent lamps, a variety of designs haven been increasingly adopted to make the fluorescent lamps slim.

Meanwhile, a plurality of fluorescent lamps 1 is connected to one another at a place where brighter light is needed. As shown in FIG. 1, an insertion groove 21 is formed on each of fixtures 20 provided at both end portions of a body 10, and a male terminal 22 is formed at the inside of the insertion groove 21. So as to connect the body 10 to one another in plural number, the male terminals 22 of the fixtures 20 of the body 10 are interconnected to those of another body 10 by means of a connection terminal part 30.

According to the conventional fluorescent lamp connecting structure, the bodies 10 of the fluorescent lamps are connected in a close contact relation to one another, thereby suppressing intermittent illumination thereof, but since both end portions of the body 10 are formed of the male terminals 22, careful attention must be paid to the direction when the bodies 10 are connected to one another, thereby failing to satisfy the safety requirements thereof. Further, if just one of the bodies 10 that is placed in the intermediate portion in the arrangement is replaced with new one, the whole bodies 10 that are mounted on a ceiling should be first disassembled, thereby making it very inconvenient to replace it with new one. Additionally, as the connection terminal part 30 is contracted or expanded by the heat generated during the usage of the fluorescent lamp 1 for a long period of time, it may be well escaped from the insertion groove 21 on the fixture 20.

To solve the above-mentioned problems, there is disclosed Korean Patent Registration No.221195 (entitled 'fluorescent lamp'), and referring simply to this prior art, the fluorescent lamp includes a body having a circuit substrate on which various parts are disposed for operating the fluorescent lamp, fluorescent lamp-fixtures disposed at both side portions of the body for fixedly inserting a fluorescent light bulb thereto, an upper cover for covering the upper portion of the body, a connecting member connected to each of the fluorescent lamp-fixtures for applying power source thereto in such a manner as to be inserted into a mounting groove formed on the end portion of the upper portion of the body, and a connector adapted to connect the connection member to another connection member.

This satisfies the safety requirements thereof, and when the plurality of fluorescent lamps are connected to one another, just a defective fluorescent lamp can be easily detached and replaced with new one.

However, a connection structure for connecting the fluorescent lamps becomes complicated, thereby undesirably increasing the manufacturing process and costs.

Furthermore, the bodies are connected with no close contact relation to one another by the connection structure for connecting the plurality of fluorescent lamps, which causes the bodies to be spaced apart from one another by a given distance, thereby making intermittent illumination thereof undesirably happened.

SUMMARY OF THE INVENTION

Accordingly, the present invention has been made in view of the above-mentioned problems occurring in the prior art, and it is an object of the present invention to provide a fluorescent lamp that is capable of being connected with an adjacent one of a plurality of fluorescent lamps by means of a sliding terminal, thereby making the configuration simple, satisfying safety requirements thereof, making it very convenient to replace it with new one, and suppressing intermittent illumination thereof by connecting the plurality of fluorescent lamps in a close relation with one another.

To achieve the above object, according to the present invention, there is provided a fluorescent lamp including: a body having fixtures mounted at both end portions thereof so as to detachably mount a fluorescent light bulb thereon; and a connecting means mounted at both end portions of the body so as to continuously electrically interconnect a plurality of bodies to one another, thereby electrically connecting the bodies (110) to one another, wherein the connecting means has a sliding terminal part slidably coupled to the fixture mounted at one side of the body in such a manner as to be selectively protruded by a given length outwardly from the fixture at the end portion thereof during forward and backward movements thereof, and a fixed terminal part formed at the fixture mounted at the other side of the body in such a manner as to be connected to the sliding terminal part by inserting the sliding terminal part thereto.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Now, an explanation of the fluorescent lamp according to the preferred embodiments of the present invention will be given.

At this time, an explanation on the same parts as in the conventional practices will be avoided for the brevity of the description.

Figure 1:
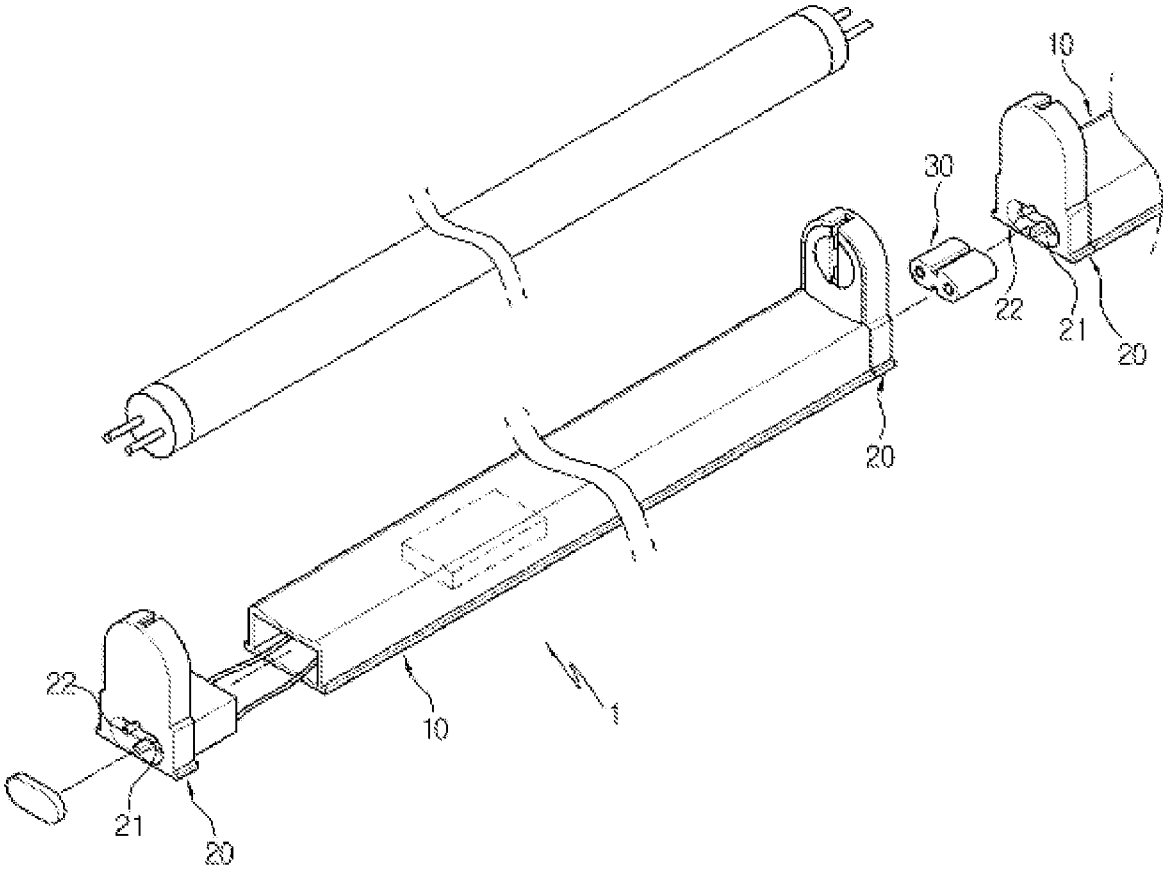
FIG. 1 is an exploded perspective view showing a fluorescent lamp connected to another fluorescent lamp in a conventional practice.
Figure 2:
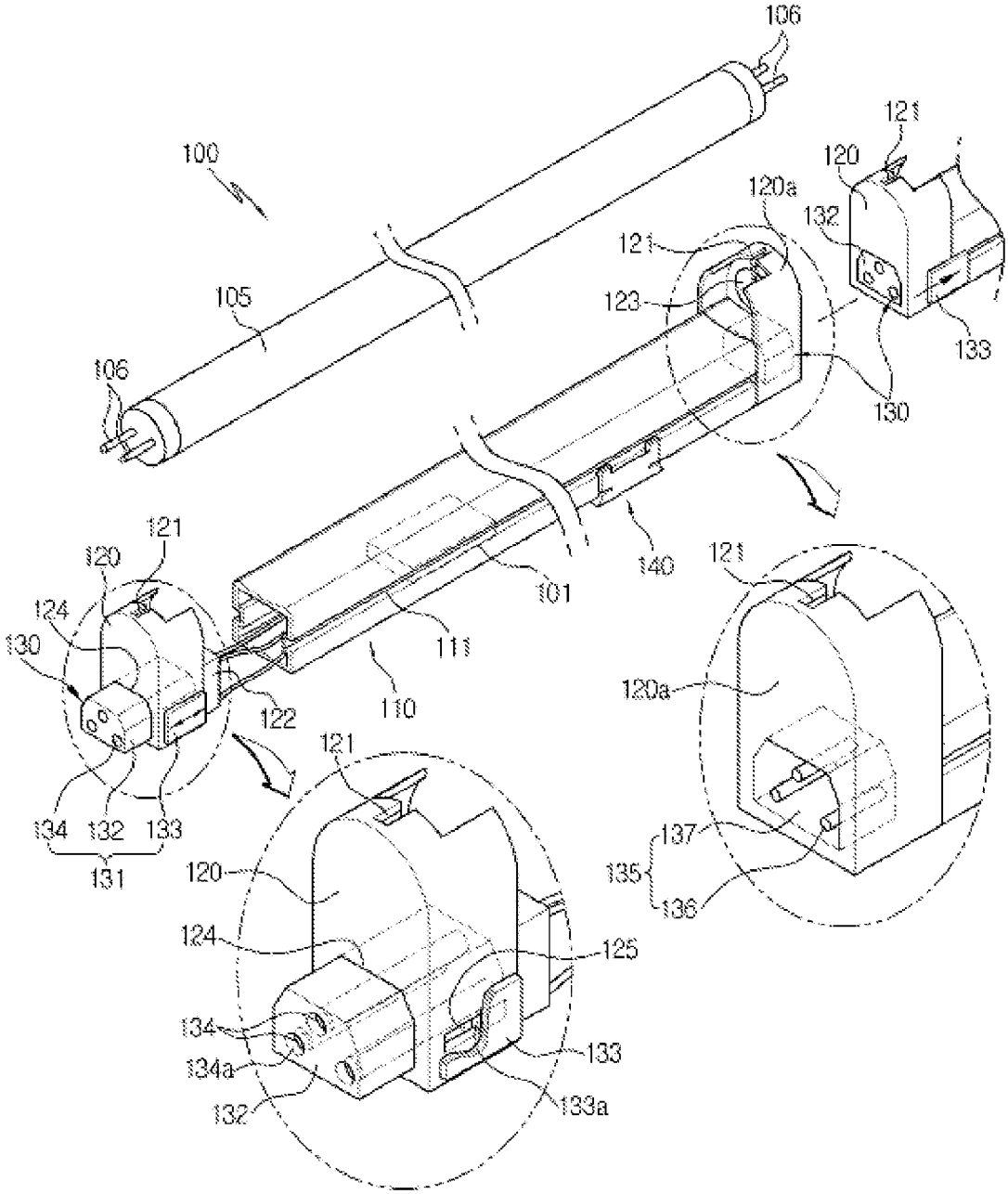
FIG. 2 is an exploded perspective view showing a fluorescent lamp connected to an adjacent fluorescent lamp according to a first embodiment of the present invention.
Figure 3:
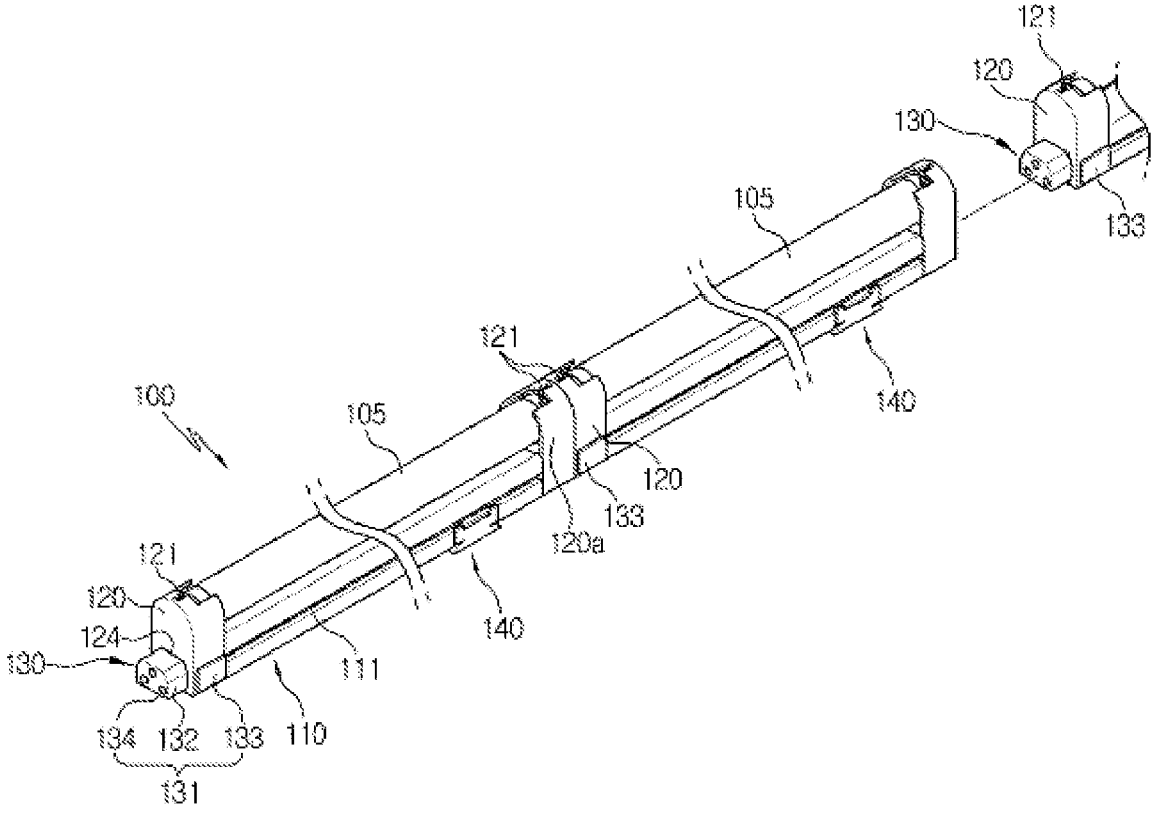
FIG. 3 is a perspective view showing the assembled state of the plurality of fluorescent lamps connected together according to the first embodiment of the present invention.
Figure 4:
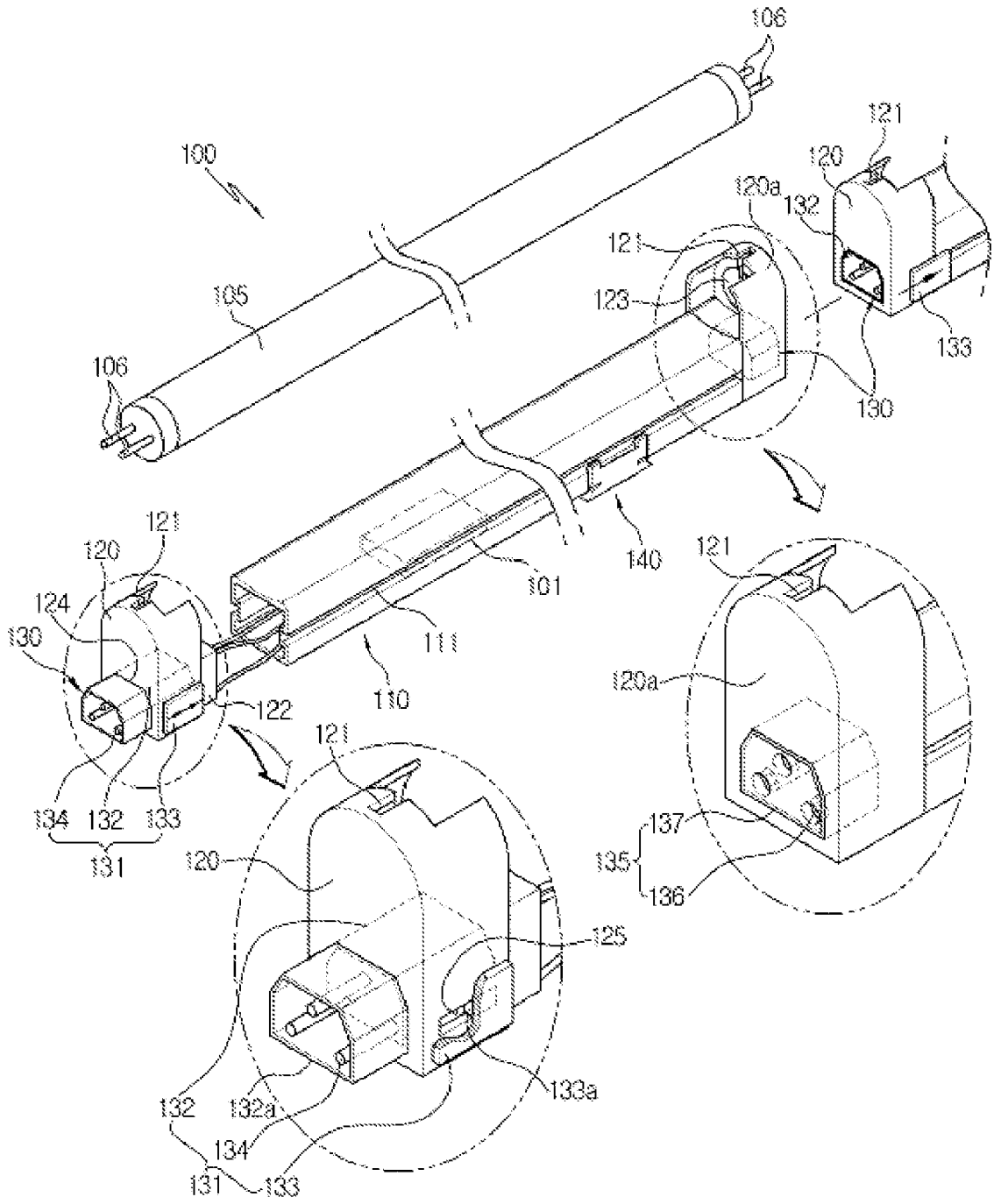
FIG. 4 is an exploded perspective view showing a fluorescent lamp connected to an adjacent fluorescent lamp according to a second embodiment of the present invention.
Figure 5:
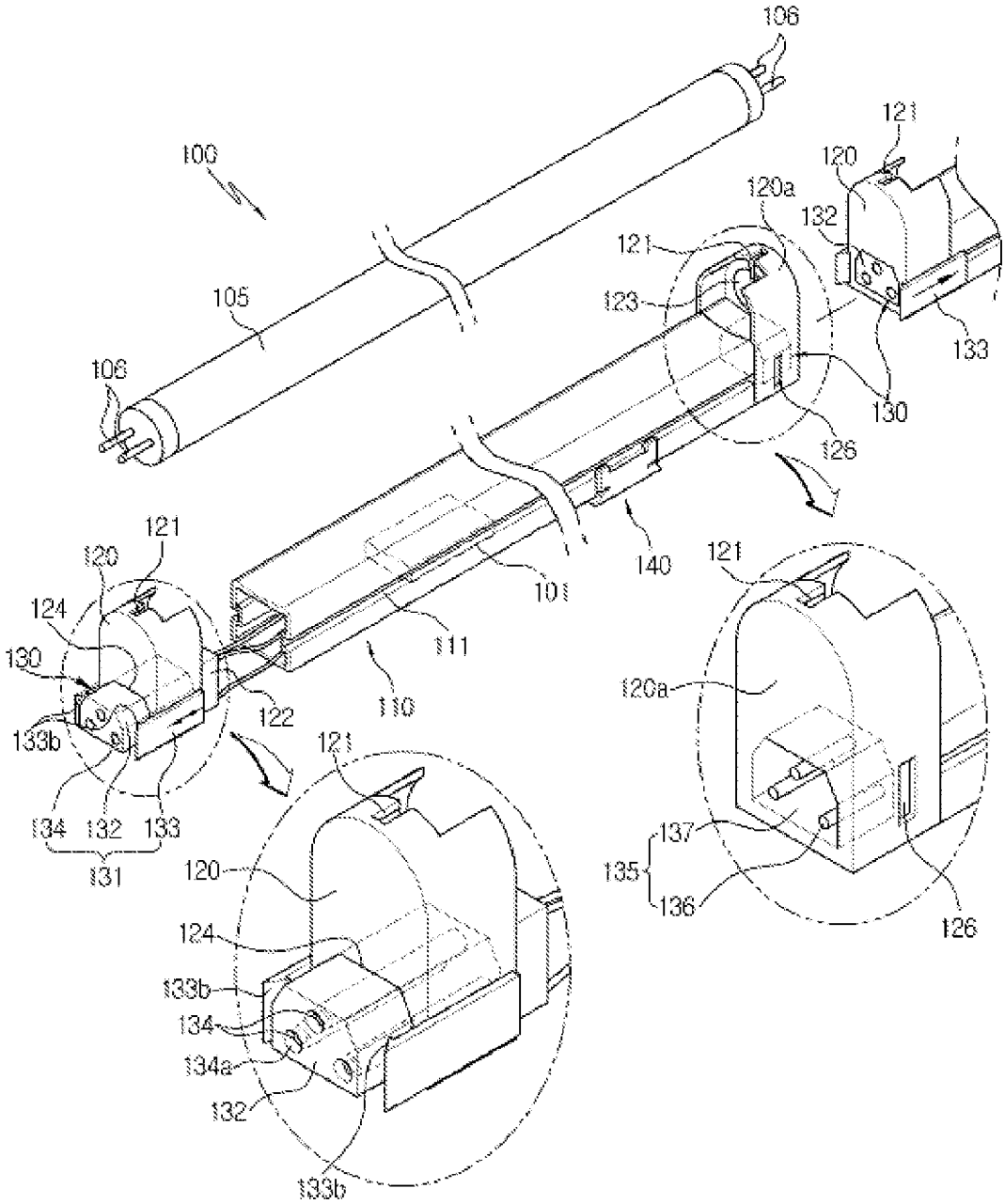
FIG. 5 is an exploded perspective view showing a fluorescent lamp connected to an adjacent fluorescent lamp according to a third embodiment of the present invention.
Figure 6:
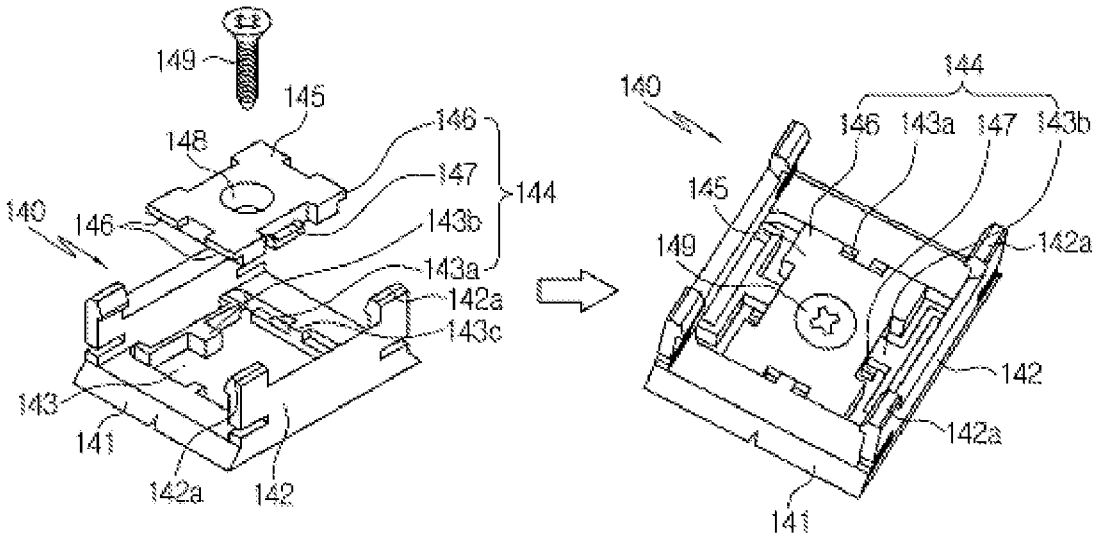
FIG. 6 is a perspective view showing a fixing bracket of the fluorescent lamp according to the preferred embodiments of the present invention.

FIG. 2 is an exploded perspective view showing a fluorescent lamp connected to an adjacent fluorescent lamp according to a first embodiment of the present invention, FIG. 3 is a perspective view showing the assembled state of the plurality of fluorescent lamps connected together according to the first embodiment of the present invention, FIG. 4 is an exploded perspective view showing a fluorescent lamp connected to an adjacent fluorescent lamp according to a second embodiment of the present invention, FIG. 5 is an exploded perspective view showing a fluorescent lamp connected to an adjacent fluorescent lamp according to a third embodiment of the present invention, and FIG. 6 is a perspective view showing a fixing bracket of the fluorescent lamp according to the preferred embodiments of the present invention.

The fluorescent lamp 100 according to the present invention largely includes a body 110, a fluorescent light bulb 105, and a plurality of fixtures 120 and 120*a* for fixing the fluorescent light bulb 105 thereto.

The body 110 is of a hollow shape and has a lighting part 101 that is generally formed of a circuit substrate, a stabilizer, or various parts (which are now shown) so as to light the fluorescent light bulb 105.

Further, each of the fixtures 120 and 120*a* has a coupling part 122 protruded inwardly therefrom in such a manner as to be inserted into each of both end portions of the body 110.

Each of the fixtures 120 and 120*a* is protruded in a perpendicular direction to the body 110 at the state of being coupled to both end portions of the body 110 and has a key indentation 121 formed at the end portion side of the protruded portion thereof so as to insert terminals 106 of the fluorescent light bulb 105 thereto at the time of being coupled with the fluorescent light bulb 105.

Therefore, at the state where the terminals 106 of the fluorescent light bulb 105 are inserted into the inside of the fixtures 120 and 120*a* through the key indentations 121 when the fluorescent light bulb 105 is rotated by 90°, it can be fixed to the fixtures 120 and 120*a*. At this time, only when the fluorescent light bulb 105 is rotated by 90°, it can be electrically connected to the lighting part 101.

In this case, each of the fixtures 120 and 120*a* has connection terminals (which are not shown) mounted at the inside thereof so as to electrically connect the terminals 106 of the fluorescent light bulb 105 to the lighting part 101 of the body 110 when the fluorescent light bulb 105 is rotated by 90°, and in the drawing, a rotary connection element 123 is mounted to guide the rotation of the fluorescent light bulb 105 after the terminals 106 of the fluorescent light bulb 105 have been inserted into the key indentations 121.

According to the fluorescent lamp 100 of the present invention, so as to continuously interconnect a plurality of bodies 110 together, a connecting means 130 is mounted at both end portion sides of the body 110. Thus, the body 110 can be detachably mounted at the adjacent body 110 and at the same time can be electrically connected thereto.

The connecting means 130 has a sliding terminal part 131 slidably coupled to the fixture 120 mounted at one end portion of the body 110 in such a manner as to be selectively protruded by a given length outwardly from the fixture 120 at the end portion thereof during forward and backward movements thereof, and a fixed terminal part 135 formed at the fixture 120*a* mounted at the other end portion of the body in such a manner as to be connected to the sliding terminal part 131 by inserting the sliding terminal part 131 thereto.

The sliding terminal part 131 includes a slider 132 slidably coupled to the inside of the fixture 120 in such a manner as to be protruded by a given length outwardly from the fixture 120 at the end portion thereof during forward and backward movements thereof, a knob 133 mounted slidably on both side walls of the fixture 120 for operating the slider 132 in forward and backward directions in a connected relation with the slider 132 by means of a guide slot 125 formed to pass through both side walls of the fixture 120, and a plurality of first terminals 134 formed on the slider 132 in such a manner as to be moved in the forward and backward directions together with the slider 132, each first terminal being formed of any one of a male terminal and a female terminal.

That is, the fixture 120 has a slide groove 124 formed at the inside thereof for slidably coupling the slider 132 in the forward and backward directions thereto, and the guide slot 125 is formed to a given length along both side walls of the slide groove 124 of the fixture 120. At this time, the knob 133 and the slider 132 are connected to each other by means of a guide 133*a* slidably mounted along the guide slot 125, such that if the knob 133 is moved forwardly and backwardly, the slider 132 is moved forwardly and backwardly together with the knob 133.

Moreover, the first terminals 134 formed on the sliding terminal part 131 are electrically connected with the lighting part 101 of the body 110.

In this case, the first terminals 134 are formed of male terminals or female terminals, and if they are formed of female terminals, like the first embodiment of the present invention as shown in FIG. 2, they are inserted into a plurality of through-holes 134*a* formed in the slider 132.

Contrarily, if they are formed of male terminals, like the second embodiment of the present invention as shown in FIG. 4, they are protruded from the end portion of the slider 132, and at this time, the slider 132 selectively has a protection case 132*a* formed to surround the first terminals 134 for protecting the first terminals 134.

And, the fixed terminal part 135 has a plurality of second terminals 136 formed at the inside of the fixture 120*a* so as to be connected to the first terminals 134, the second terminals 136 being formed of one of male terminals and female terminals to correspond to the shapes (male or female terminals) of the first terminals 134.

That is, if the first terminals 134 are formed of male terminals, the second terminals 136 are formed of female terminals, and contrarily, if the first terminals 134 are formed of female terminals, the second terminals 136 are formed of male terminals.

Most preferably, as shown in FIG. 2, the first terminals 134 provided in the slider 132 are formed of female terminals, and the second terminals 136 are formed of male terminals.

At this time, the fixture 120*a* in which the second terminals 136 are formed has an insertion groove 137 adapted to insert the slider 132 or the protection case 132*a* of the slider 132 thereto. The insertion groove 137 is formed of the same shape as the slider 132, and if the protection case 132*a* is formed on the slider 132, it is formed of the same shape as the protection case 132*a*.

On the other hand, if the slider 132 is inserted into the insertion groove 137, the fixtures 120 and 120*a* of the adjacent bodies 110 come in close contact with each other, thereby suppressing the intermittent illumination therebetween.

Furthermore, the body 110 has a retaining groove 111 formed longitudinally along both side surfaces thereof, and a fixing bracket 140 is detachably mounted to the retaining groove 111 so as to fixedly mount the body 110 to a ceiling.

As shown in FIG. 6, the fixing bracket 140 includes: a body 141 having both side walls 142 protruded vertically therefrom, a locking protrusion 142*a* formed at the end portions of each of both side walls 142, and a mounting hole 143 penetratingly formed at the central portion at the inside thereof, so as to be detachably mounted to the retaining groove 111; and a fixing plate 145 adapted to be coupled to the mounting hole 143 by means of a coupling means 144 in such a manner as to be elastically moved, the fixing plate having a screw hole 148 formed in the central portion thereof for fixing to the ceiling.

The coupling means 144 includes: a pair of retaining parts 143*a* formed along a pair of facing inner sides of the mounting hole 143; a pair of tension parts 143*b* formed along the other pair of facing inner sides of the mounting hole 143 for elastically supporting the sides of the fixing plate 145; a pair of first seating parts 146 formed on both sides of the fixing plate 145 in such a manner as to be seated on the upper sides of the retaining parts 143*a*; and a pair of second seating parts 147 formed on the other both sides of the fixing plate 145 in such a manner as to be seated on the lower sides of the tension parts 143*b*.

In this case, each of the retaining parts 143*a* has a protrusion 143*c* at the center portion thereof, and each of the first seating parts 146 seated on the upper sides of the retaining part 143*a* is divided into two parts with respect to the protrusion 143*c*. That is, when the first seating parts 146 are moved elastically at the state where they are seated on the retaining parts 143*a*, the formation of the protrusions 143*c* prevents the first seating parts 146 from being excessively moved to one side.

Moreover, the tension parts 143*b* are always adapted to elastically support the side surfaces of the fixing plate 145, and at the state where the fixing plate 145 is assembled with the body 11 if the fixing plate 145 is fixed to the ceiling by using the screw 149, the body 141 can be somewhat moved elastically by the tension parts 143*b*.

In this case, the fixing plate 145 is assembled easily with the body 141 by using the elasticity of the tension parts 143*b*, and after the assembling, the first and second seating parts 146 and 147 of the fixing plate 145 keep supporting the upper sides of the retaining parts 143*a* and the lower sides of the tension parts 143*b* of the body 142 thereagainst, such that they are not disassembled before a given force is applied thereto.

On the other hand, as shown in FIG. 5, the knob 133 that is slidably mounted at the fixture 120 formed on one side of the body 110 has a retaining projection 133*b* formed at one end portion thereof, and the fixture 120*a* formed on the other side of the body 110 has a groove 126 formed on the outer side surface thereof in such a manner as to fixedly insert the retaining projection thereto upon the forward movement of the knob 133. Therefore, the plurality of bodies 110 can be connected to one another in a more stable manner.

Now, an explanation on an operation of the fluorescent lamp 100 according to the preferred embodiments of the present invention will be given.

First, in case where the fluorescent lamp 100 is mounted at a ceiling, the fixing bracket 140 that is made by assembling the fixing plate 145 and the body 141 is fixedly mounted at the ceiling by using the screw 149, and after that, if the body 110 is inserted into the inside of the fixing bracket 140, the retaining grooves 111 formed along both side surfaces of the body 110 are locked to the locking protrusions 142*a* of the body 141, such that the fluorescent lamp 100 can be fixed to the ceiling with ease.

At this time, in case where the bodies 110 are continuously connected together, if the bodies 110 are not arranged linearly, it is not easy to insert the slider 132 into the insertion groove 137 formed on the fixture 120*a* of the adjacent body 110 even under the advancement of the knob 133. However, according to the present invention, the body 141 is elastically moved by the tension parts 143*b*, such that even though the plurality of bodies 110 are not arranged in a line (linearly), the slider 132 can be gently inserted into the insertion groove 137.

Next, in case where the plurality of bodies 110 that are mounted continuously in a line are electrically connected together, the knob 133 of the sliding terminal part 131 is moved forwardly to make the slider 132 protruded outwardly from the fixture 120, and after that, the protruded slider 132 is inserted into the insertion groove 137 formed in the fixture 120*a* of the adjacent body 110.

In other words, the slider 132 is protruded outwardly from the fixture 120*a* and is inserted into the insertion groove 137 of the adjacent body 110, thereby simply connecting the plurality of bodies 110 together. At this time, if the slider 132 is inserted into the insertion groove 137, the first terminals 134 provided on the slider 132 are connected to the second terminals 136 provided in the insertion groove 137, thereby electrically connecting the plurality of bodies 110 together.

Like this, if power is supplied to the fluorescent lamp 100 after the connection of the plurality of bodies 110, it is supplied at the same time to the plurality of bodies 110 connected by the coupling of the sliding terminal part 131 and the fixed terminal part 135, thereby lighting up the fluorescent light bulbs 105.

Further, in case where one of the plurality of bodies 110 after mounting is replaced with new one, the knob 133 of the sliding terminal par 131 is moved backwardly. As a result, the protruded slider 132 is moved backwardly and separated from the insertion groove 137, thereby achieving the replacement with ease. Of course, the fixing bracket 140 is mounted at the ceiling for fixing the body 110 thereto, but if a given force is applied thereto, the locking protrusions 142*a* of the fixing bracket 140 can be easily deviated from the retaining grooves 111 of the body 110.

As described above, there is provided a fluorescent lamp according to the present invention that is capable of being connected with an adjacent one of a plurality of fluorescent lamps by means of a sliding terminal, thereby making the configuration simple, making the lamp device to safety requirements thereof, making it very convenient to replace it with new one, and suppressing intermittent illumination thereof by connecting the plurality of fluorescent lamps in a close relation with one another.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A fluorescent lamp comprising:

a body (110) having fixtures (120 and 120*a*) mounted at both end portions thereof so as to detachably mount a fluorescent light bulb (105) thereon; and a connecting means (130) mounted at both end portions of the body (110) so as to continuously interconnect a plurality of bodies to one another, thereby electrically connecting the bodies (110) to one another, wherein the connecting means (130) has a sliding terminal part (131) slidably coupled to the fixture (120) mounted at one side of the body (110) in such a manner as to be selectively protruded by a given length outwardly from the fixture (120) at the end portion thereof during forward and backward movements thereof, and a fixed terminal part (135) formed at the fixture (120*a*) mounted at the other side of the body (110) in such a manner as to be connected to the sliding terminal part (131) by inserting the sliding terminal part (131) thereto.

2. A fluorescent lamp according to claim 1, wherein the sliding terminal part (131) comprises:

a slider (132) slidably coupled to the inside of the fixture (120) in such a manner as to be protruded by a given length outwardly from the fixture (120) at the end portion thereof during forward and backward movements thereof;

a knob (133) mounted slidably on both side walls of the fixture (120), for operating the slider (132) in forward and backward directions in a connected relation with the slider (132) by means of a guide slot (125) formed to pass through both side walls of the fixture (120); and a plurality of first terminals (134) formed on the slider (132) in such a manner as to be moved in the forward and backward directions together with the slider (132), each first terminal (134) being formed of any one of a male terminal and a female terminal.

3. A fluorescent lamp according to claim 2, wherein if the first terminal (134) are formed of female terminals, the first terminals (134) are inserted into a plurality of through-holes (134*a*) formed in the slider (132), and if the first terminals (134) are formed of male terminals, the first terminals (134) are protruded from the end portion of the slider (132) and the slider (132) selectively has a protection case (132*a*) formed to surround the first terminals (134) for protecting the first terminals (134).

4. A fluorescent lamp according to claim 2, wherein the fixed terminal part (135) has a plurality of second terminals (136) formed at the inside of the fixture (120*a*) so as to be connected to the first terminals (134), each second terminals (136) being formed of any one of a male terminal and a female terminal to correspond to the shapes of the first terminals (134).

5. A fluorescent lamp according to claim 4, wherein the fixture (120*a*) has an insertion groove (137) adapted to insert the slider (132) thereto.

6. A fluorescent lamp according to claim 2, wherein the knob (133) slidably mounted at the fixture (120) has a retaining projection (133*b*) formed at one end portion thereof, and the fixture (120*a*) has a groove (126) formed on the outer side surface thereof in such a manner as to fixedly insert the retaining projection (133*b*) thereto upon the forward movement of the knob (133).

7. A fluorescent lamp according to claim 1, wherein the body (110) has a retaining groove (111) formed longitudinally along both side surfaces thereof, and a fixing bracket (140) is detachably mounted to the retaining groove (111) so as to fixedly mount the body (110) to a ceiling, the fixing bracket (140) comprising:

a body (141) having both side walls (142) protruded vertically therefrom, a locking protrusion (142*a*) formed at the end portions of each of both side walls (142), and a mounting hole (143) penetratingly formed at the central portion at the inside thereof so as to be detachably mounted to the retaining groove (111); and a fixing plate (145) adapted to be coupled to the mounting hole (143) by means of a coupling means (144) in such a manner as to be elastically moved, the fixing plate having a screw hole (148) formed in the central portion thereof for fixing to the ceiling.

8. A fluorescent lamp according to claim 7, wherein the coupling means (144) comprises:

a pair of retaining parts (143*a*) formed along a pair of facing inner sides of the mounting hole (143);

a pair of tension parts (143*b*) formed along the other pair of facing inner sides of the mounting hole (143) for elastically supporting the sides of the fixing plate (145);

a pair of first seating parts (146) formed on both sides of the fixing plate (145) in such a manner as to be seated on the upper sides of the retaining parts (143*a*); and a pair of second seating parts (147) formed on the other both sides of the fixing plate (145) in such a manner as to be seated on the lower sides of the tension parts (143*b*).

* * * * *